United States Patent [19]

Frost et al.

[11] 4,287,705

[45] Sep. 8, 1981

[54] SADDLES

[76] Inventors: Robert T. Frost; May Frost, both of 6675 Bluebird Ave., Longmont, Colo. 80501

[21] Appl. No.: 134,523

[22] Filed: Mar. 27, 1980

[51] Int. Cl.[3] ..... B68C 1/02; B68C 1/16

[52] U.S. Cl. ..... 54/44; 54/46

[58] Field of Search ..... 54/23, 37, 38, 42, 44, 54/45, 46, 47

[56] References Cited

U.S. PATENT DOCUMENTS

| | | | |
|---|---|---|---|
| 28,867 | 6/1860 | Jenifer | 54/44 |
| 749,358 | 1/1904 | Brooke | 54/46 |
| 1,321,398 | 11/1919 | Sievert | 54/44 |
| 1,503,715 | 8/1924 | Schnitger | 54/46 X |
| 1,610,989 | 12/1926 | Aguilar | 54/44 X |
| 1,767,630 | 6/1930 | Warren | 54/37 |
| 3,153,887 | 10/1964 | Bohlin | 54/37 |
| 3,286,440 | 11/1966 | Walker et al. | 54/44 |
| 3,312,040 | 4/1967 | Nuzzo | 54/44 |
| 3,529,402 | 9/1970 | Queen | 54/44 |
| 3,807,136 | 4/1974 | Deal | 54/44 X |

*Primary Examiner*—Gene Mancene
*Assistant Examiner*—Robert P. Swiatek
*Attorney, Agent, or Firm*—Hugh H. Drake

[57] ABSTRACT

A saddle has a rigid tree somewhat conformed on its underside to fit the back of a horse and on its upper side to seat a person thereastride. A cinch is removably mounted to the saddle for encircling the girth of the horse and stirrups are adjustably hung on each side. A pair of comparatively wide, flat sleeves depend centrally from the opposing sides of the tree, with a rigid ring being disposed in the end portion of each sleeve. The cinch is adjustably fastened between the rings. A flexible strap has its opposing ends secured between the rings and runs through the sleeves and over the top of the tree. Stirrup hangers are hung from the tree in corresponding locations aligned over the flexible strap.

6 Claims, 3 Drawing Figures

SADDLES

The present invention pertains to saddles. More particularly, it relates to a saddle suitable for endurance riding.

Of course, the art of saddlery goes back many centuries. Man has long desired a better seat for himself atop the back of an animal trained to carry him. At least in the United States, most saddles for the riding of horses fall within two general classes. One is of the so-called English style and the other is referred to as being of the western style. In either case, the saddle defines a seat which fits atop the back of the horse and which the user straddles. At the front of the seat, the saddle is designed variously in shape to accommodate the withers of the horse. This area is called the pommel or fork. On the other hand, the rear of the seat typically rises into a somewhat pan-shaped member called the cantle.

Forming the basic shape of and underlying the seat is a rigid frame known as the tree. It is conformed on its underside to fit the back of a horse, usually with the interpositioning of a layer of soft material, such as sheepskin or stuffed leather panels. Even then, a separate blanket or pad of resilient material typically is employed between the saddle and the hide of the horse in order further to protect and guard against the forming of sores on the horse.

Many saddles have been devised with special features to assist in the performance of particular tasks. For example, different designs have been produced to accommodate each different one of a variety of rodeo events. Thus, there have been roping saddles, bulldogging saddles, broncoriding saddles and so forth. Each of those different saddles has its own special features which are designed to best enable the user to perform the event concerned.

On the other hand, attention also has been given in the design of saddles to accommodation of the horse. Most of this effort has gone into proper shaping of the underside of the saddle, so that it fits the back of the horse in a manner which does not cause the development of sores. Poorly-fitted saddles often are accommodated by the employment of more layers of padding between the saddle and the horse. However, that may be undesirable in that such extra layers of padding do not allow as firm and stable a fit of the saddle upon the horse, and the extra padding may defeat its purpose or otherwise tire the horse because of the buildup of increased sweat under the padding and at the surface of the horse's hide. In any case, the necessity to use increased padding or saddle blankets is a bother.

In earlier years, most western-style saddles employed a tree shaped from wood the different parts of which were tied together with rawhide. Saddles constructed in this manner were heavy, adding to the burden of the horse and also to the inconvenience of the handler. Recent years have been increased use of materials such as fiberglass to form the trees. The latter material is strong, comparatively light in weight and also readily capable of being molded in a manner best to exhibit conformations comfortable both to the horse and to the rider. Nevertheless, the rigging associated with the saddle has tended to remain much the same. That is, the saddle includes some kind of girth-encircling arrangement, usually referred to generally as the cinch, which ties opposing side margins of the saddle around the barrel of the horse. To allow variation of tension in the cinch, the saddle always includes some kind of adjustable fastening in the cinch arrangement. Unfortunately, the manner of securing and fastening the cinch often serves as its own source of the development of sores on the horse when the horse is ridden for an extended period of time.

Most saddles also include stirrups in which the rider inserts at least the toes of his feet. Those stirrups are invariably hung from the sides of the saddle. For reasons that are not entirely clear, the stirrup hangers often are suspended from the saddle at points horizontally spaced from the cinch. As the user changes positions during different aspects of riding, this difference in points of suspension, as between the cinch and the stirrup hangers, can lead to the development of fore and aft forces on the saddle which may create rubbing against the hide of the horse and cause the formation of sores.

Considering that the use of saddles goes back for many centuries, and that horseback riding either for pleasure or for work continues actively, it is not surprising that the prior patent art contains the disclosure of numerous variations. Believed to be representative thereof are U.S. Pat. Nos. 749,358—Brooke, 1,503,715—Schnitger, 1,767,630—Warren, 3,153,887—Bohlin, 3,286,440—Walker et al. and 3,312,040—Nuzzo.

Brooke shows a long-used manner of suspending a cinch strap, involving a yoke the upper ends of which are suspended across the front and rear of the saddle. The stirrups are hung as normally positioned somewhat forward of the cinch. For comfort of the rider, there is a cover extending over the seat and down both sides. Schnitger also has such a yoke for suspending the cinch, that yoke apparently also including a central strap that is carried over the top of the saddle.

Packframes for carrying objects, rather than human riders, on a horse also have faced the problem of being adequately secured without causing sores. Warren is typical in providing a rigging that includes a cinch coupled to the rigging through rigid rings that are disposed low on the horse for proper stability. Bohlin hangs stirrup straps from a pin assembly secured into a multi-part tree. Nuzzo aligns stirrup straps with a cinch assembly that is secured to the sides of a tree arrangement; a metal bar extends between the two upper ends of the cinch for re-inforcement purposes. Walker et al. include a cinch strap assembly that excends over the top of a flexible, multi-layered tree assembly. It also is known, at least in English saddles, to extend a short flexible strap over the top of a tree and in the seat portion thereof, a cinch being secured by buckles and billets or the like to that strap.

All of the foregoing prior art has found a degree of success for its purpose. Nevertheless, available saddles have continued to pose a problem of injury to the horse when used for a long period of time or discomfort to the rider when similarly so used. Given an experienced rider who has learned how to re-adjust his own position from time to time, so as to relieve discomfort, it normally is the horse which suffers injury to the hide during what may be called endurance riding.

It is, accordingly, a general object of the present invention to provide a new and improved saddle which overcomes deficiencies in prior saddles, including those mentioned hereinabove.

Another object of the present invention is to provide a new and improved saddle especially adapted for the riding of the horse over a long and substantially continuous period of time.

A further object of the present invention is to provide a new and improved saddle which enables the attainment of the other objects and yet which does not involve any significant increase in complexity and cost of manufacture.

A saddle constructed in accordance with the present invention thus is of the kind which has a rigid tree conformed on its underside to fit properly atop the back of a horse and on its upper side to comfortably seat a person astride the saddle. A cinch is removably mounted to the saddle for encircling of the girth of the horse, and stirrups are adjustably hung from respective sides of the saddle. One feature involves the provision of a pair of comparatively wide, flat sleeves centrally depending individually from respective sides of the tree. A pair of rigid rings are individually disposed in the respective lower end portions of each of the sleeves. Respective ends of the cinch are secured by adjustable fastening between the rings. A flexible strap has its opposing ends secured to respective ones of the rings and extends from the rings through the sleeves and over the top of the tree. Another feature involves a pair of hangers individually disposed on opposing sides of the saddle for the stirrups. The hangers are suspended at locations aligned over the flexible strap.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
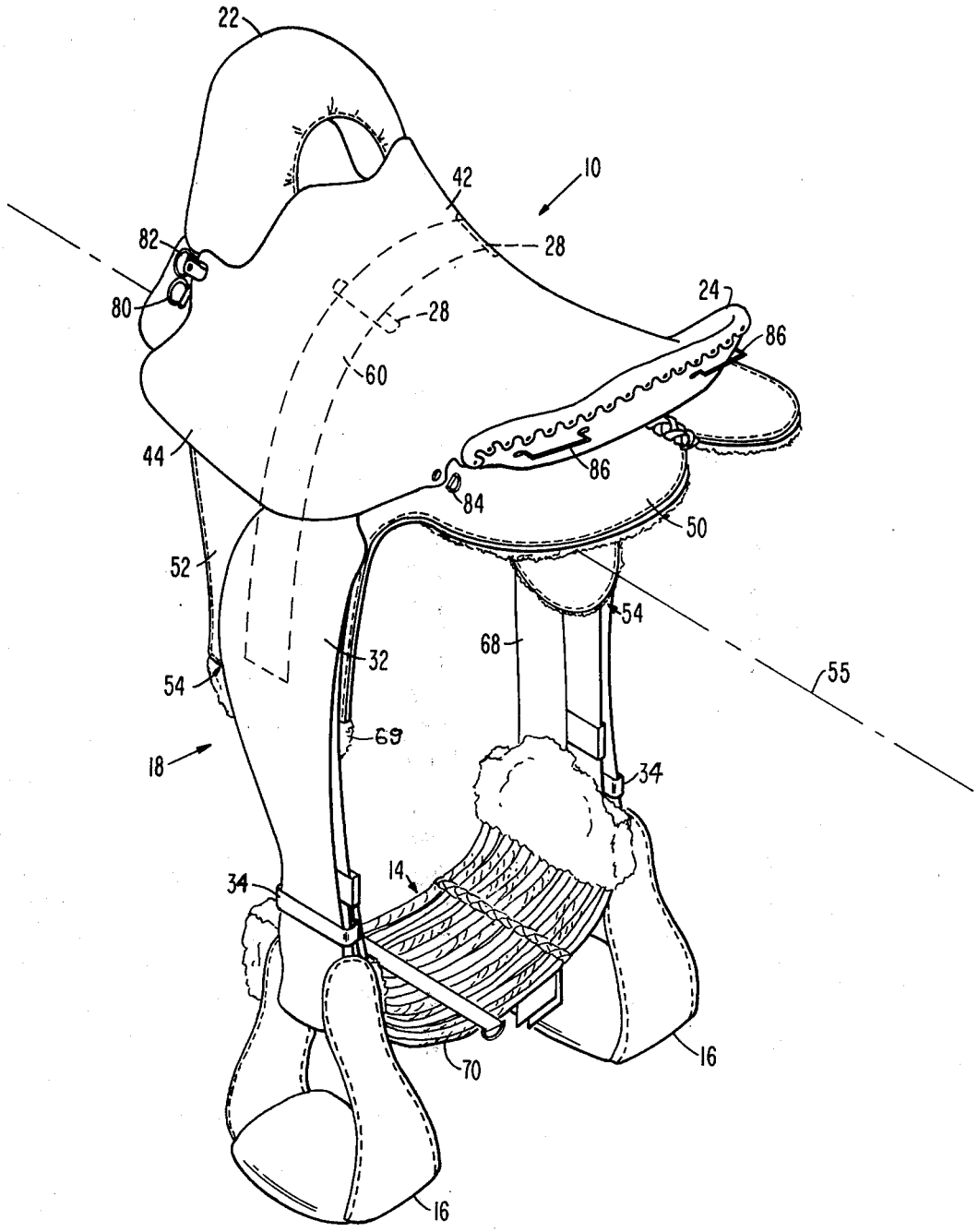
FIG. 1 is an isometric view of a saddle constructed in accordance with an embodiment of the present invention.
Figure 2:
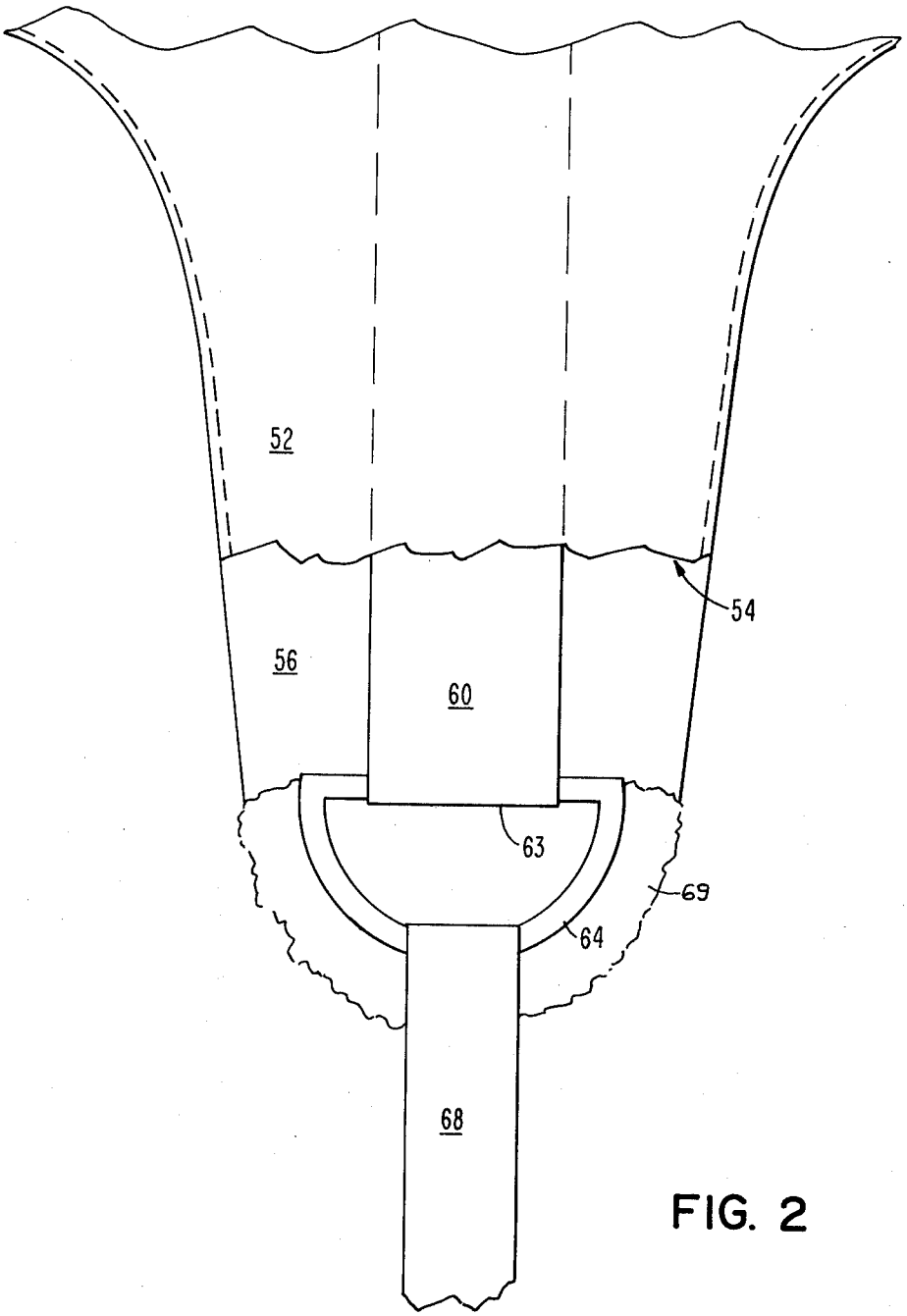
FIG. 2 is a fragmentary view partially broken away, of a portion of the saddle shown in FIG. 1.
Figure 3:
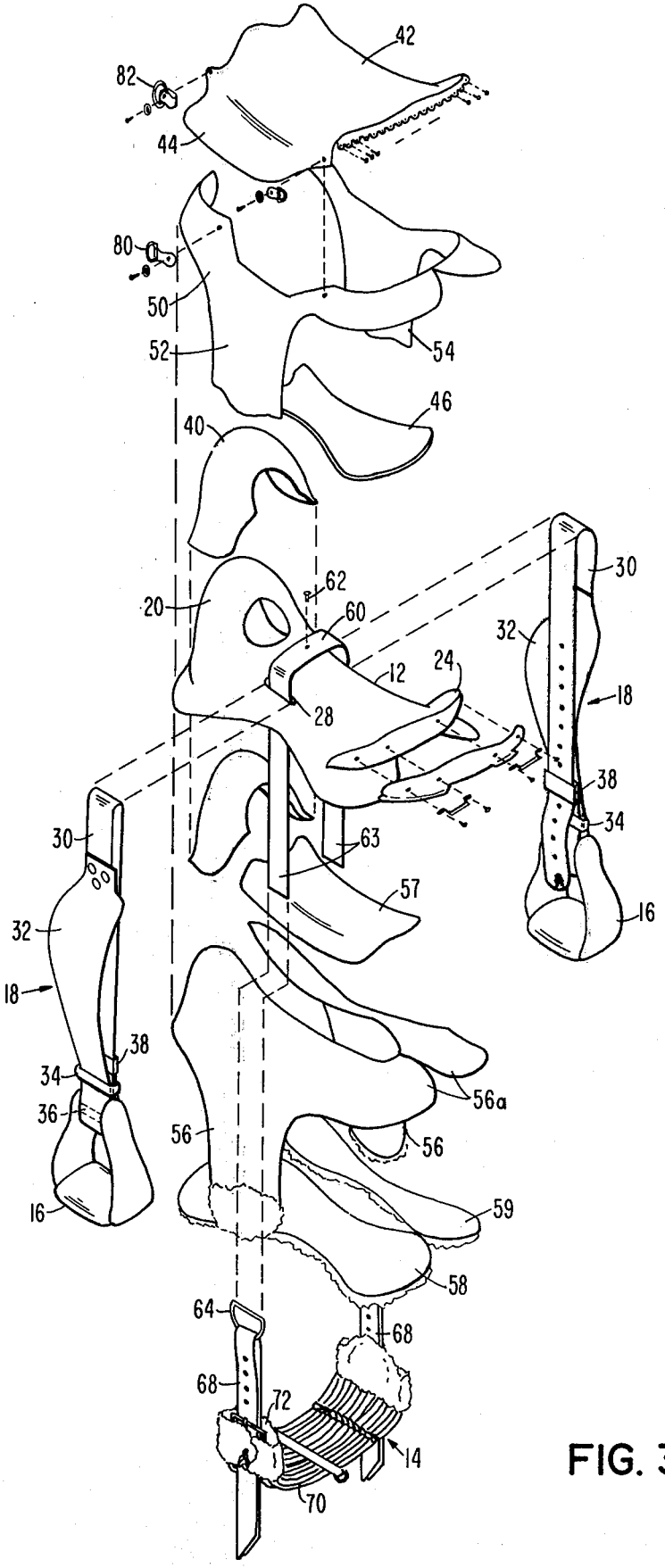
FIG. 3 is an exploded isometric view of the saddle assembly.

A saddle 10 has as its basic component a rigid tree 12 preferably molded from fiberglass. The underside of tree 12 is conformed so that the saddle fits properly atop the back of a horse. On the other hand, the upper side of tree 12 is conformed to comfortably seat a rider astride a saddle. A cinch 14 is removably mounted to the saddle for encircling the girth of the horse. Stirrups 16 are adjustably suspended by hangers or fenders 18 from respective sides of saddle 10.

Formed to project upwardly on the front end of tree 12 is a swell 20 that is to form a fork or pommel 22 in the finished saddle. Toward the rear and again projecting upwardly from tree 12 is a cantle 24.

Disposed in each side marginal portion of tree 12 is a slot 28. Looped over the lower edge of each slot 28 is a stirrup leather 30 that continues downwardly from the slot into a laterally enlarged fender panel 32 which then tapers downwardly into a strap portion that encircles a bolt 36 across the top of each stirrup 16. Behind fender panel 32, stirrup leather 30 continues as a strap into an adjustable fastener 38 which completes formation of hanger 18 and allows suspension of stirrup 16 in a conventional manner. A hobble strap 34 encircles the lower part of the fender below panel 32 at a point above stirrup 16. Fender panel 32 is of sufficient width in the horizontal direction as to provide a soft and protective shield inside the knee of the person riding the saddle.

Fork 22 is encased with an outer layer 40 of leather. Another layer 42 of leather covers the entire seat area and extends over the top of cantle 24. That layer also depends downwardly on each side of the saddle and over the upper portion of fender 32 as a seat jockey 44. As is customary, a resilient padding 46 is interposed between layer 42 and tree 12 so as to form a cushioned seat. Moreover, the leather of which layer 42 is made is supple, so as to guard against chafing of the skin of the rider.

Extending over the upper margins of tree 12, generally beneath cantle 24 and toward the front around the lower end of fork 22, is a skirting layer 50 preferably again of leather. Leather is the preferred material for all such layers and also for at least most of the straps, except as specifically to be described hereinafter, although it is to be recognized that another material might be substituted and a better material might some day be developed.

In this case, skirting layer 50 continues downwardly over each lateral side margin of the saddle in a comparatively wide and flat front panel 52 of a sleeve 54. The side margins of panel 52 are stitched to a rear panel 56 that completes formation of the sleeve. Sleeves 54 extend from tree 12 to a position below the barrel axis 55 of the horse on which the saddle is to be mounted and with respect to which barrel the saddle is designed to ride on top. Panels 56 diverge in width and extend underneath tree 12 and an overlying central channel cover 57. A similar cover is conformed beneath swell 20. Padding strips 58 and 59 are disposed longitudinally on either side of the undersurfaces of the flared portions 56*a* of panels 56. Padding strips 58 and 59 preferably are sheepskin.

A flexible strap 60, preferably of woven nylon fibers, extends through sleeve 54, under the lower rung that defines slot 28, and over the top of tree 12. Strap 60 is riveted directly to tree 12 in the region of the seat as indicated at 62. The opposing ends of strap 60 are secured at 63 to D-rings 64. Each D-ring 64 is disposed and laterally confined at the lower end portion of sleeve 54. A strap 68 is secured at one end about each D-ring 64 and extends on downwardly. Rings 64 are formed of rigid metal and lie atop the portion of sleeve 54 which, in use, lies adjacent to the hide of the horse. Front panel 52 of sleeve 54 is preferably of a shorter downward extent so as slightly to expose D-rings 64 and the connection of strap 68. In any event, the underlying panel of sleeve 54 with sheepskin padding 69 shields D-ring 64 from contact with the hide of the horse, while the outside panel of sleeve 54 is arranged to accommodate fastening of the cinch.

As always seems to be the case in current practice, the saddle is designed to be mounted upon the horse with use of a cinch 70. In common use, cinch 70 is a multiple-strand construction of parallel cords. On each end of cinch 70 is a rigid ring 72 which may or may not have a buckle tongue. In this particular embodiment, strap 68 is inserted through ring 72 and is buckled into place by means of the tongue.

In use, it will be observed that the saddle as illustrated includes other features of interest to the user. D-rings 80 accommodate a breast collar. Rings 82 accommodate the carrying of a halter rope or other fastening to the saddle. Rings 84, on either side of cantle 24, facilitate the tying of apparatus, such as saddlebags, to the rear of the saddle, and equipment loops 86, on the rear of cantle 24, also are included. These parts are normal appendages and may be varied as desired.

Hanger 18, by being suspended from slot 28, enables the user to swing stirrup 16 back and forth as may be desired during use of the saddle. At the same time, hanger 18 is suspended in direct alignment over the girth supporting system. This helps to insure that action of the rider does not impart excessive forces of the saddle and its mounting arrangement against the hide of the horse.

Sleeve 54, and the dimensioning related to it, protects the horse and eliminates interference between the stirrup hangers and the girth supporting system. At the same time, sleeve 54 provides a smooth surface adjacent to the horse. This avoids chafing as a result of swinging of the rider's legs forward and backward as when standing in the stirrups in a balanced position on varying terrain during endurance riding. Rings 64 are protected from direct engagement with the horse by back panel 56 of the sleeve which is padded with sheepskin 69 underneath the ring. Yet they allow looping of strap 68 as the connection to cinch 70 is made and tightened. At the same time, ring 64 is disposed well below the barrel axis of the horse so as to insure stable seating of the saddle thereupon.

It will thus be seen that the entire saddle is secured by a cinching arrangement which shields the hard coupling elements from the hide of the horse, disposes those coupling elements well below the barrel axis of the horse so as to impart stability, shields those coupling elements from contact with the legs of the rider or from external contact with objects near to which the horse may be ridden, and aligns all of the different components in a manner to minimize tendency of the saddle to chafe the hide of the horse. At the same time, the rider is provided with a comfortable seat close to the horse.

While a particular embodiment of the invention has been shown and described, and alternatives have been mentioned, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. In a saddle having a rigid one-piece tree with a forward pommel and a rearward cantle and conformed on its underside to fit properly atop the back of a horse and on its upper side to comfortably seat a person astride the saddle, a cinch removably mounted to the saddle for encircling the girth of the horse and stirrups adjustably hung from respective sides of the saddle, the improvement comprising:

a pair of comparatively wide, flat and laterally-enclosed sleeves centrally depending from between said pommel and cantle and individually from respective sides of said tree;

a pair of rigid rings individually disposed within and substantially confined against lateral movement by the respective lower end portions of each of said sleeves;

adjustable fastening means for securing respective ends of said cinch between said rings;

a flexible strap having its opposing ends secured to respective ones of said rings and extending from said rings through said sleeves and said tree and over the top of said tree;

and a covering layer atop said tree for separating said strap from said person, whereby said sleeves, rings, fastening means and strap inhibit fore, aft or rocking movement of said saddle on said horse.

2. A saddle as defined in claim 1 in which a pair of slots are individually formed centrally through respective side-marginal portions of said tree, in which said flexible strap extends downwardly through said slots from atop the portion of said tree therebetween; and in which said covering layer is of supple material and overlies the portion of said strap which extends over the top of said tree.

3. A saddle as defined in claim 2 which includes a pair of hangers individually disposed on the opposing sides of said saddle in corresponding locations aligned over said flexible strap, hung at their upper ends from said tree and removably coupled at their lower ends to corresponding ones of said stirrups.

4. A saddle as defined in claim 3 in which the upper end portions of said hangers individually also extend through respective ones of said slots.

5. A saddle as defined in claim 1 in which said flexible strap is fixedly secured directly to said tree.

6. A saddle as defined in claim 1 in which the underside of said tree is conformed to sit atop the barrel of a horse, and in which the lengths of said sleeves and said flexible strap are sufficient to dispose said rings below the axis of said barrel.

* * * * *